United States Patent [19]

Klebe

[11] 4,295,303

[45] Oct. 20, 1981

[54] GEODETIC DOME

[76] Inventor: Wilmer A. Klebe, 35 Park Ave., Petaluma, Calif. 94952

[21] Appl. No.: 80,743

[22] Filed: Oct. 1, 1979

[51] Int. Cl.[3] ..... E04B 1/32

[52] U.S. Cl. ..... 52/81; 52/223 R; 52/741

[58] Field of Search ..... 52/227, 80, 81, Dig. 10, 82, 223R, 224, 741; 403/217, 218; 135/4 R, 135/2 R, 3 R

[56] References Cited

U.S. PATENT DOCUMENTS

| | | | |
|---|---|---|---|
| 1,117,600 | 11/1914 | Plue | 52/82 |
| 2,397,345 | 3/1946 | Gilleland | 52/780 |
| 2,775,794 | 1/1957 | Keely | 52/82 |
| 3,468,082 | 9/1969 | Hadley | 52/81 |
| 3,690,998 | 9/1972 | Brynjegard | 52/DIG. 10 |
| 3,908,329 | 9/1975 | Walters | 52/82 |

OTHER PUBLICATIONS

Dome Book 2 by Pacific Domes, Bolina, California, 1971, pp. 23, 25 and 55.

*Primary Examiner*—John E. Murtagh
*Attorney, Agent, or Firm*—Townsend and Townsend

[57] ABSTRACT

A manner of constructing a geodetic dome which is not labor-intensive and does not require skilled labor is disclosed. The joints for the dome structure each include a spool having an outer surface with a radially projecting circumferential spline. The beams which form the skeleton of the dome have ends which abut the outer surfaces of the spools and engage the splines to prevent movement of the beams axially with respect to the spools. The beams are retained against the spools to prevent movement of the beams radially with respect to the spools. Panels can be inserted in grooves formed in the confronting surfaces of the beams to complete the dome structure.

25 Claims, 6 Drawing Figures

GEODETIC DOME

BACKGROUND OF THE INVENTION

The present invention relates to geodetic domes, and in particular to a simplified geodetic dome construction.

Many attempts have been made to reduce the cost of housing and other building structures. Conventional building techniques are labor-intensive, and the labor used must be relatively skilled, resulting in high costs. Factory-built housing, including mobile homes, uses inexpensive labor but is often found to be aesthetically undesirable and has other problems limiting its application in the housing market. New types of building structures, such as geodetic domes, are usually as expensive or more expensive to construct than conventional building structures because their construction is also labor-intensive and requires skilled labor.

The present invention provides a manner of constructing a geodetic dome which is not labor-intensive and does not require skilled labor. The joints for the dome structure each include a spool having an outer surface with a radially projecting circumferential spline. The beams which form the skeleton of the dome have ends which abut the outer surfaces of the spools and engage the splines to prevent movement of the beams axially with respect to the spools. The beams are retained against the spools to prevent movement of the beams radially with respect to the spools.

It is preferred that the beams be retained against the spools by tension members passing through slits in the beams and biasing the beams against the spools. The dome structure of the present invention can be completed by inserting panels into grooves formed in the confronting surfaces of the beams. A skin may be used to cover the beams, and the space between the skin and the panels filled with insulation.

The geodetic dome structure of the present invention can readily be constructed by unskilled workers. The entire structure fits together like a jigsaw puzzle, but when constructed, is extremely strong and durable, belying its minimal cost of construction. Geodetic dome structures constructed according to the teachings of the present invention can be used for housing, greenhouses, and other applications.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
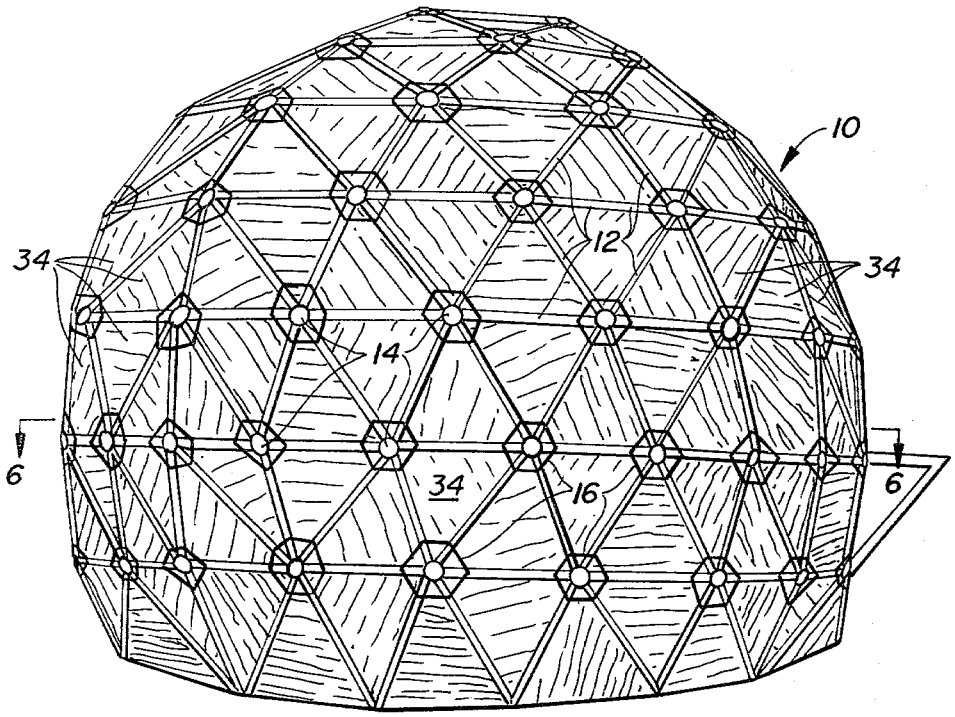
FIG. 1 is a perspective view of a geodetic dome construction according to the teachings of the present invention.

A geodetic dome 10 constructed according to the teachings of the present invention is illustrated generally by way of reference to FIG. 1. Dome 10 includes a plurality of beams 12 which form a skeletal framework for the dome. The various beams 12 meet at their ends at various joint locations, each of which is defined by a spool 14 in the present invention. Beams 12 are fixed to spools 14 by tension members 16 surrounding each of the spools.

FIG. 1 illustrates a type of dome in which the joints lie in discrete horizontal planes. However, the present invention is applicable to other types of geodetic dome constructions as well.

Figure 2:
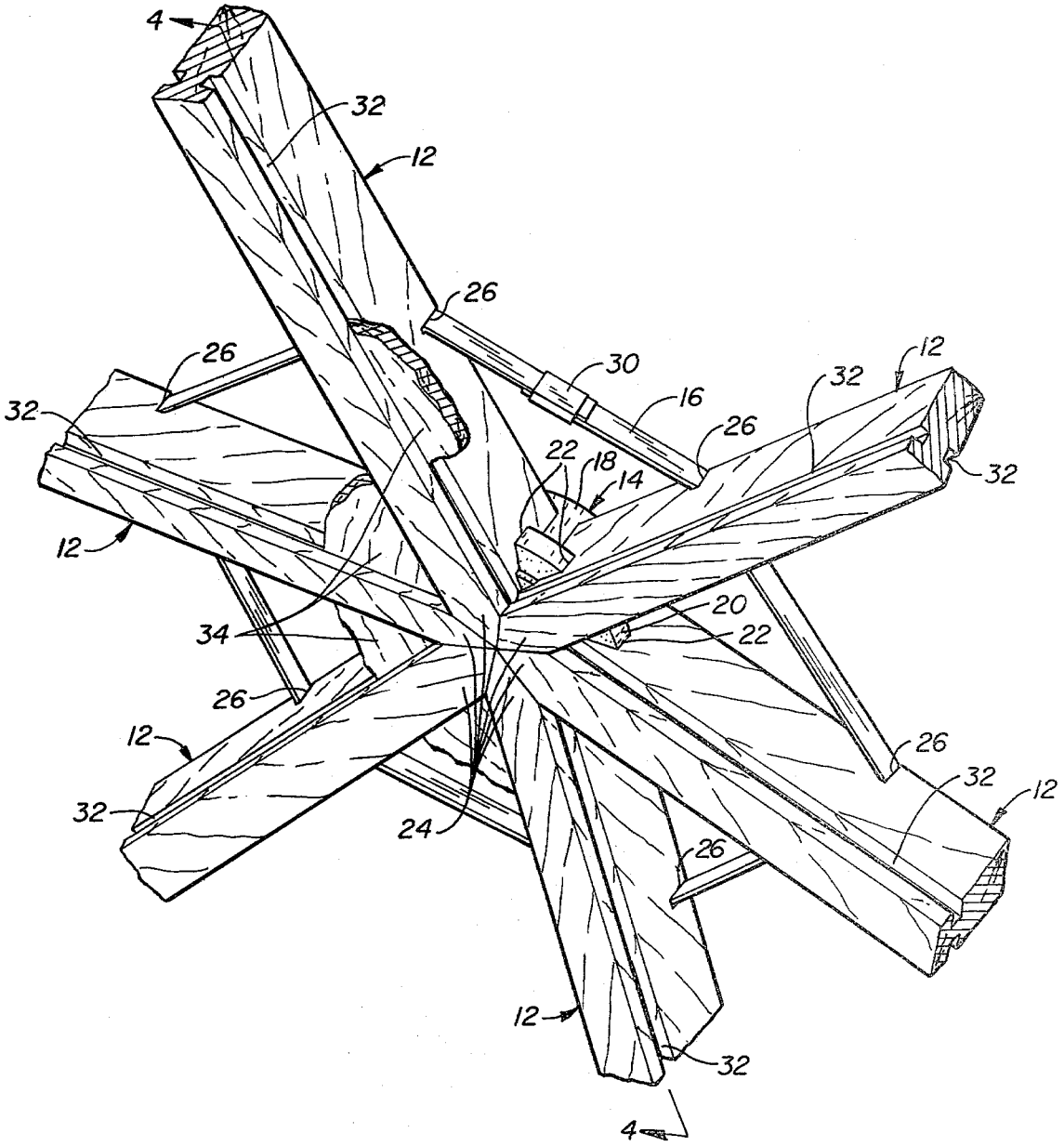
FIG. 2 is a fragmentary perspective view of one of the joints used in the dome construction of FIG. 1.
Figure 3:
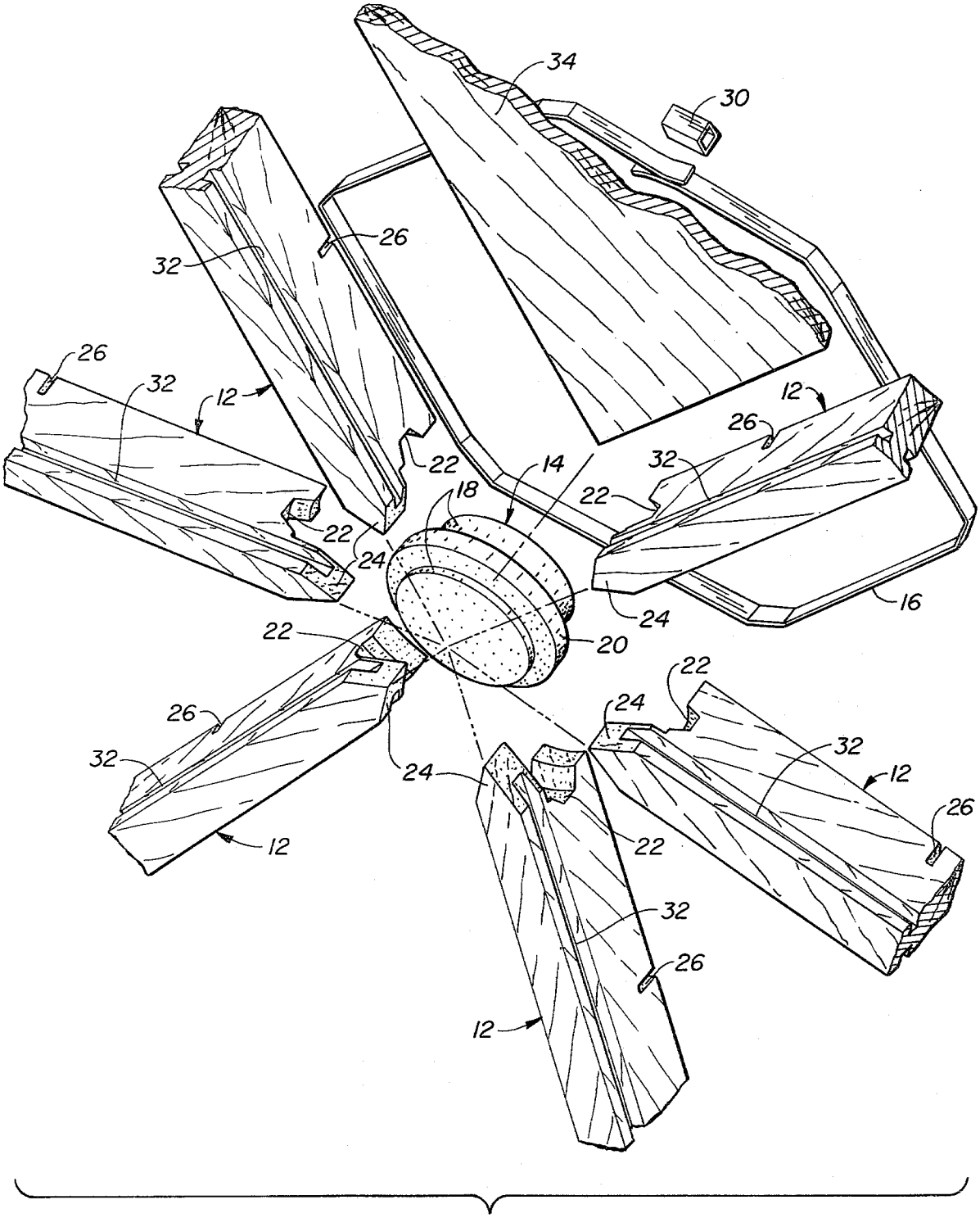
FIG. 3 is an exploded view of the joint of FIG. 2.
Figure 4:
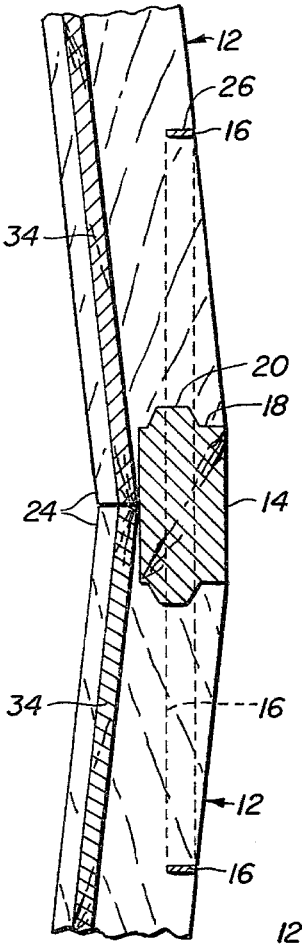
FIG. 4 is a sectional view taken alongs lines 4—4 of FIG. 2.

The joint construction of dome 10 is illustrated in more detail by way of reference to FIGS. 2–4 in combination, all of the joints being generally the same except for the angle at which beams 12 intersect spool 14.

Spool 14 has an outer circumferential surface 18 which is circular in section. A raised circumferential spline 20 projects outwardly from outer surface 18. Preferably, spline 20 is located intermediate the ends of outer circumferential surface 18, but in certain applications dual splines may be used at each end of the spool.

Each beam 12 has a notch 22 conformed to spline 20 so that the beam end engages the spline. Moreover, the portion of the end of each beam 12 adapted to abut the circumferential surface 18 of spool 14 is contoured so that that portion of the beam end rests flush against the surface.

A portion 24 of the end of each beam 12 is adapted to overlie one end of spool 14. The side edges of portions 24 are inclined so that they rest flush against one another and provide a smooth, aesthetically pleasing surface, as illustrated clearly in FIG. 2. In geodetic domes in which beams 12 meet at irregular angles, the side surfaces of portions 24 of each beam end are contoured specifically to accommodate the desired angle of intersection.

Each beam 12 has a slit 26 spaced from the end of the beam abutting spool 14. A tension member 16 consisting of a metal band is inserted in the slits 26 and circumscribes spline 14. Tension members 16 is placed under tension to force beams 12 against spool 14, and is clamped in position using cleat 30.

Each beam 12 has a pair of grooves 32 which confront corresponding grooves on the adjacent beams. Panels 34 are inserted between adjacent beams 12 and are received in grooves 32. An adhesive can be applied to the grooves to fix panels 34 in position.

The depth of slits 26 is selected so that band 16 lies in the same plane as spline 20, as illustrated in FIG. 4. Accordingly, the forces exerted by tension member 18 will be applied directly against spline 20 of spool 14, and transverse stresses will not be applied against the spline. Member 16 holds beams 12 against spool 14 to prevent radial movement of the beams relative to the spool. The engagement of notches 22 with spline 20 prevents movement of beams 12 axially with respect to spool 14. The transverse dimensions of beams 12 and their abutment against the outer surface 18 of spool 14 prevents rotational movement of the beams relative to the spline. Accordingly, the joint construction illustrated above provides a rigid interconnection of the beams at the dome joints.

In the embodiment of the present invention illustrated, grooves 34 are located proximate the interior edges of beams 12. This would be the typical configuration in the construction of a dwelling, and in such an installation, most panels 34 would be opaque, with certain panels transparent to provide window members. If a greenhouse is to be constructed, all panels 34 would typically be transparent or at least translucent, and the grooves would most likely be located toward the exterior of beams 12.

Figure 5:
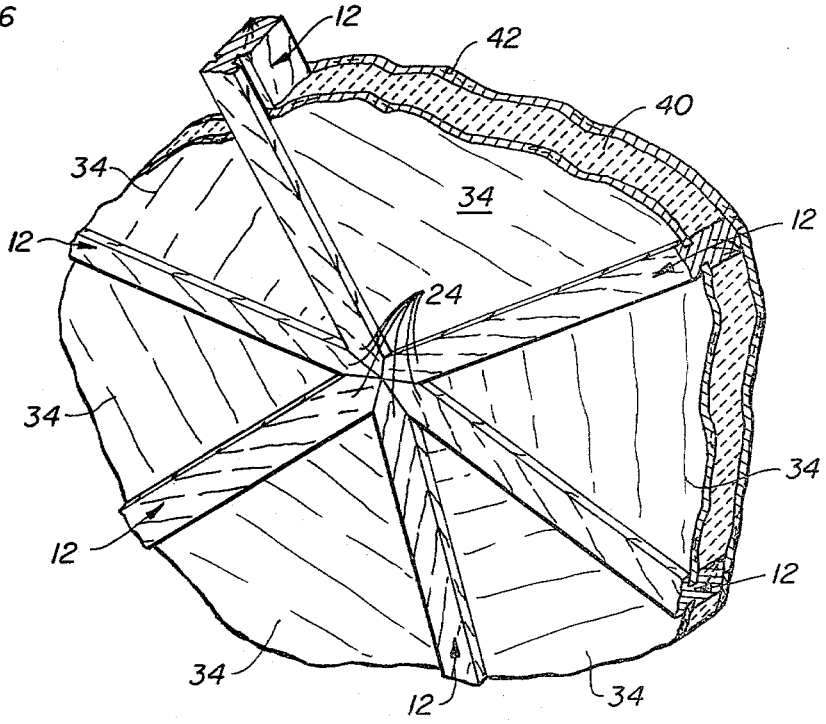
FIG. 5 is a fragmentary perspective view of the joint of FIG. 2 with a skin and insulation added to the dome.

In a dwelling, it may be desirable to add insulation to the dome construction, as illustrated in FIG. 5. An insulation material 40, typically of the foam variety, is used to fill the spaces between beams 12 overlying panels 34. A skin material 42 is attached to the outer surfaces of beams 12, and sandwiches foam material 40 between skin 42 and panels 34.

Figure 6:
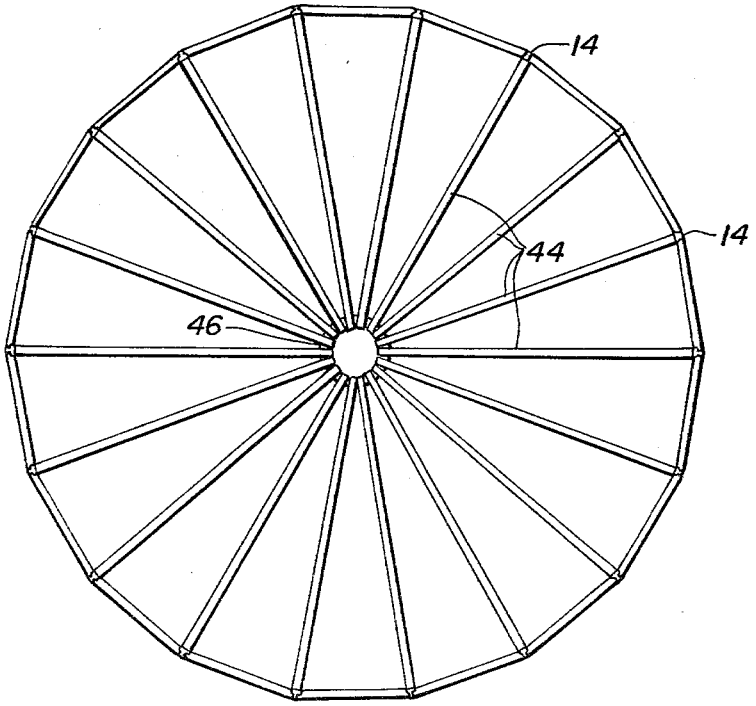
FIG. 6 is a section view taken along lines 6—6 of FIG. 1 and showing a support structure for a second floor within the dome.

Referring back to FIG. 1, it is apparent that at the semispherical location of dome 10, referred to as the "equator" of the dome, all of the splines 14 point directly inwardly, with their axes lying in a common horizontal plane. Accordingly, extensions 44 can be formed on each spline 14, as illustrated in FIG. 6, with the extensions extending inwardly to engage a support ring 46. Typically, splines 14 at the equator and the extensions 44 are constructed from a single square timber which is turned at its ends to form the splines. Extensions 44 provide convenient structural support for overlying floor. In certain types of geodetic domes, the splines do not lie along the dome equator and this aspect of the invention is inapplicable.

The geodetic dome 10 of the present invention is adapted to be constructed primarily of wood. Beams 12, spools 14, and panels 34 are all typically of wood construction, although certain variations are possible. Tension member 16, of course, is typically metal.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A joint for a geodetic dome structure comprising:

a spool having an outer surface including a radially projecting circumferential spline;

a plurality of beams having ends abutting the outer surface of the spool and engaging the spline to prevent movement of the beams axially with respect to the spool, each said beam having engaging means spaced from the end of the beam in abutment with the spool; and a tension member passing through the engaging means in the beams and coplanar with the spool to retain the beams against the spool and prevent movement of the beams radially with respect to the spool.

2. The joint of claim 1 wherein the outer surface of the spool is circular in section.

3. The joint of claim 1 wherein the beam ends are notched to engage the spline.

4. The joint of claim 1 wherein the beams have grooves along their confronting surfaces for the support of panels between the beams.

5. A joint for a geodetic dome construction comprising:

a spool having an outer surface which is circular in section, said outer surface including a radially projecting circumferential spline;

a plurality of beams having ends abutting the outer surface of the spool, each beam end having a notch engaging the spline to prevent movement of the beam ends axially with respect to the spool, the confronting surfaces of the beams having grooves formed therein, each said beam including a transverse slit spaced from its beam end abutting the spool;

a continuous tension member passing through the slits in the beams and coplanar with the spool to bias the beams toward the spool to prevent movement of the beams radially with respect to the spool; and a plurality of panels spanning adjacent beams and received in the grooves to form an enclosed dome construction.

6. The joint of claim 5 wherein the tension member comprises a metal band under tension.

7. The joint of claim 5 wherein the tension member is coplanar with the spline.

8. The joint of claim 1 or 5 wherein the beam ends are shaped to conform to the outer surface of the spool.

9. The joint of claim 1 or 5 wherein a portion of the beam ends of each beam overlie one end of the spool, and wherein said portions are cut so as to be flush with one another.

10. The joint of claim 1 or 5 wherein the spline is circumferentially continuous.

11. The joint of claim 1 or 5 wherein the spline is spaced inwardly from the ends of the spool.

12. A geodetic dome structure comprising:

a plurality of spools each having an outer surface including a radially projecting circumferential spline;

a plurality of beams having ends which abut respective spools and engage the splines on the spools to prevent movement of the beam ends radially with respect to the spools, said beams having engaging means spaced from the ends thereof; and a plurality of tension members circumscribing and coplanar with the respective spools in engagement with the engaging means of the beam ends abutting the associated spools to bias the beam ends against the abutting spools and prevent movement of the beams radially with respect to the spools.

13. The structure of claim 12 wherein the spools are circular in section.

14. The structure of claim 12 wherein the beams have grooves in their confronting surfaces, and additionally comprising a plurality of panels inserted in the grooves to complete the dome structure.

15. The structure of claim 14 and additionally comprising an adhesive retaining the panels in the grooves.

16. The structure of claim 14 and additionally comprising a skin covering the outer surface of the beams, and insulation located between the skin and the panels.

17. The structure of claim 12 where the engaging means comprises slits formed in the beams, and wherein the tension members comprise bands under tension.

18. The structure of claim 12 wherein the spools and the beams are made of wood.

19. The structure of claim 12 wherein certain of the spools are disposed about the semispherical equator of the dome in a horizontal plane and wherein the spools include extensions extending inwardly from said certain spools into the interior of the dome structure to form a support for a floor.

20. A method for constructing a geodetic dome comprising the steps of:

locating a plurality of splined spools at the respective joints where the beams forming the dome skeleton intersect;

abutting the ends of the beams which form the dome skeleton against the spools in engagement with the splines so that the positions of the beam ends are fixed axially with respect to the spools;

circumscribing the spools with metal bands coplanar with the associated spool inserted in slits formed in the beams in abutment with the associated spool; and tensioning the bands to force the beams against the spools so that the positions of the beams are fixed radially with respect to the spools.

21. The method of claim 20 and additionally comprising the step of inserting panels into grooves formed in the confronting surfaces of the beams to complete the dome structure.

22. The method of claim 21 and additionally comprising the step of adhering a skin material to the exterior surfaces of the beams.

23. The method of claim 22 and additionally comprising the step of filling the material between the panels and the skin with insulation.

24. The method of claim 20 and additionally comprising the step of forming the ends of the beams so that they rest flush against the spools.

25. The method of claim 20 and additionally comprising the step of forming the ends of the beams so that a portion of each beam end overlies one end of the associated spool, and cutting said portions so that the beams in combination form flat surfaces over said ends of the spools.

* * * * *